US006021727A

United States Patent [19]

Ku

[11] Patent Number: 6,021,727

[45] Date of Patent: Feb. 8, 2000

[54] UPPER THREAD-HOOKING DEVICE FOR AN INDUSTRIAL SEWING MACHINE

[76] Inventor: Fei-Lung Ku, No. 10, Alley 6, Lane 148, Kai Yuan Road, Tainan, Taiwan

[21] Appl. No.: 09/296,427

[22] Filed: Apr. 23, 1999

[51] Int. Cl.[7] ..... D05B 65/00

[52] U.S. Cl. ..... 112/286; 112/300

[58] Field of Search ..... 112/475.17, 286, 112/253, 291, 293, 294, 295, 300, 285, 163

[56] References Cited

U.S. PATENT DOCUMENTS 5,025,739 6/1991 Inoue ..... 112/286
5,417,173 5/1995 Mitsuji ..... 112/291 X

*Primary Examiner*—Peter Nerbun
*Attorney, Agent, or Firm*—Rosenberg, Klein & Lee

[57] ABSTRACT

An upper thread-hooking method for industrial sewing machines uses an upper thread-hooking device installed above one side of the needle and the presser foot for hooking the thread and cutting with a cutter by means of an electronic component moving a main sway arm and an auxiliary sway arm. The hooking device is located between the needle eye and the needle point behind the needle, performing a hooking thread process so that the hooking member never occupies the gap between the needle point and the presser foot. Then the sewing machine may have the highest rising level for the presser foot for comparative thick cloth to be sewn, without possibility of the hooking member colliding with the needle or the presser foot.

1 Claim, 8 Drawing Sheets

UPPER THREAD-HOOKING DEVICE FOR AN INDUSTRIAL SEWING MACHINE

BACKGROUND OF THE INVENTION

This invention relates to an upper thread-hooking method for an industrial machine. Particularly, the invention is directed to a hooking member of an upper thread-hooking device that does not occupy the gap between a needle point and the presser foot, so that the thickness of a cloth to be sewn may be as thick as possible, and the hooking member will not collide with a needle during operation of the hooking member.

A conventional upper thread-hooking device of a sewing machine is shown in FIGS. 6–10, including an electronic component 11, a side plate 12 fixed on a side of the electronic component 11, a main sway arm 13, and an auxiliary sway arm 14 as main components.

The side plate 12 has a curved slot 121 in an intermediate portion sloping down for a screw to insert to connect an upper end 132 of the main sway arm 13 with the side plate 12. A curved horizontal hole 122 is formed at the left side of the curved slot 121 for connecting an upper end 141 of the auxiliary sway arm 14 with an outer end of the connecting rod of the electronic component 11 with a bolt 143 and a nut 122. The intermediate section 134 of the main sway arm is connected to a second end of the auxiliary sway arm 14, which has a bent corner 142 fixed with the side plate 12 with a bolt 143 and a nut 122, with the bolt 143 functioning as a pivot for the auxiliary sway arm 14 to sway. Then the first end 141 of the auxiliary sway arm 14 may be connected to a function end 111 of the connecting rod of the electronic component 11.

In operation of the upper thread-hooking device of the conventional sewing machine, when the needle 15 is raised to the highest point, the electronic component 11 is powered to let the connecting rod pull the function end 111, and the auxiliary sway arm 14 moves along the curved hole 122 to the other end. Thus, the auxiliary sway arm 14 restrains the main sway arm 13 to move down along the curved slot 121 so that the hooking member 131 can hook back the thread 16 carried by the needle in sewing. Then, the thread 16 is cut off by a cutter under the slide plate 1, and the other end of the thread carried by the needle 15 is caught between the two front plate springs 131 to keep the front short end of the thread 16 on the slide plate when the needle 15 makes another sewing cycle, for leaving no front end of the thread in the sewing process.

The greatest advantage of the conventional upper thread-hooking device is that the front end of the thread is hidden, not completely exposed. When the needle 15 rises to the highest point, the hooking in the gap between the needle point and the presser foot occurs, hooking the thread 16 again to the right side.

However, the above mentioned hooking method still has drawbacks in practical use, as follows.

1. The presser foot presses cloth during sewing, and is at different levels in accordance with the thickness of the cloth being sewn, so the gap between the needle point and the presser foot may vary accordingly. Thus, the gap may become very small for the hooking member to pass through, but the gap between the needle point and the slide plate is definite and unchangeable, when the needle rises to the highest point. So, that creates a limit in using this conventional upper thread hooking device, as shown in FIGS. 9 and 10.

2. As the hooking member is located directly under the needle point and performs the hooking action in the gap between the needle point and the presser foot, there should be an ample gap to permit the whole hooking member to move with a safety tolerance, so that the hooking member will not collide with the needle point or the presser foot, as shown in FIG. 10. Consequently, the rising distance of the presser foot is limited after the hooking member is installed. Then, the range of thickness of cloth to be sewn will be decreased. It a cloth that is too thick is used, the hooking member may collide with the presser foot or the needle.

3. The needle is located at a very high point in some types of industrial sewing machines, and the gap between the needle point and the slide plate may be 8 mm (in such machines as the BROTHER FD4-B272) for sewing comparatively thick cloth used in winter clothing. But the hooking member and the safe tolerance needs about 3 mm. So this kind of industrial sewing machine is still not so suitable for use with thick cloth used for winter clothing. The automatic sewing operation and the hooking device with the thread end hidden, of this type, cannot be used as such, but performed by manual operation.

SUMMARY OF THE INVENTION

This invention has been devised to offer an upper thread-hooking method for industrial sewing machines, using a hooking member to perform hooking the thread behind the needle in coordination with the feed dog moving cloth so that the gap between the needle point and the presser foot does not affect the hooking action of the hooking member, even if the presser foot is raised to its highest level. This method can apply to any type of sewing machine and maintain the original gap between the needle point and presser foot.

Another purpose of the invention is to offer an upper thread-hooking method for industrial sewing machines to permit the hooking member to move back and forth, not under the needles, in hooking the thread, so there is not a possibility of breaking the needle or the presser foot, and without interruption of the sewing work.

BRIEF DESCRIPTION OF THE DRAWINGS

This invention will be better understood by reference to the accompanying drawings, wherein.

DETAILED DESCRIPTION OF THE PREFERRED EMBODIMENT

Figure 1:
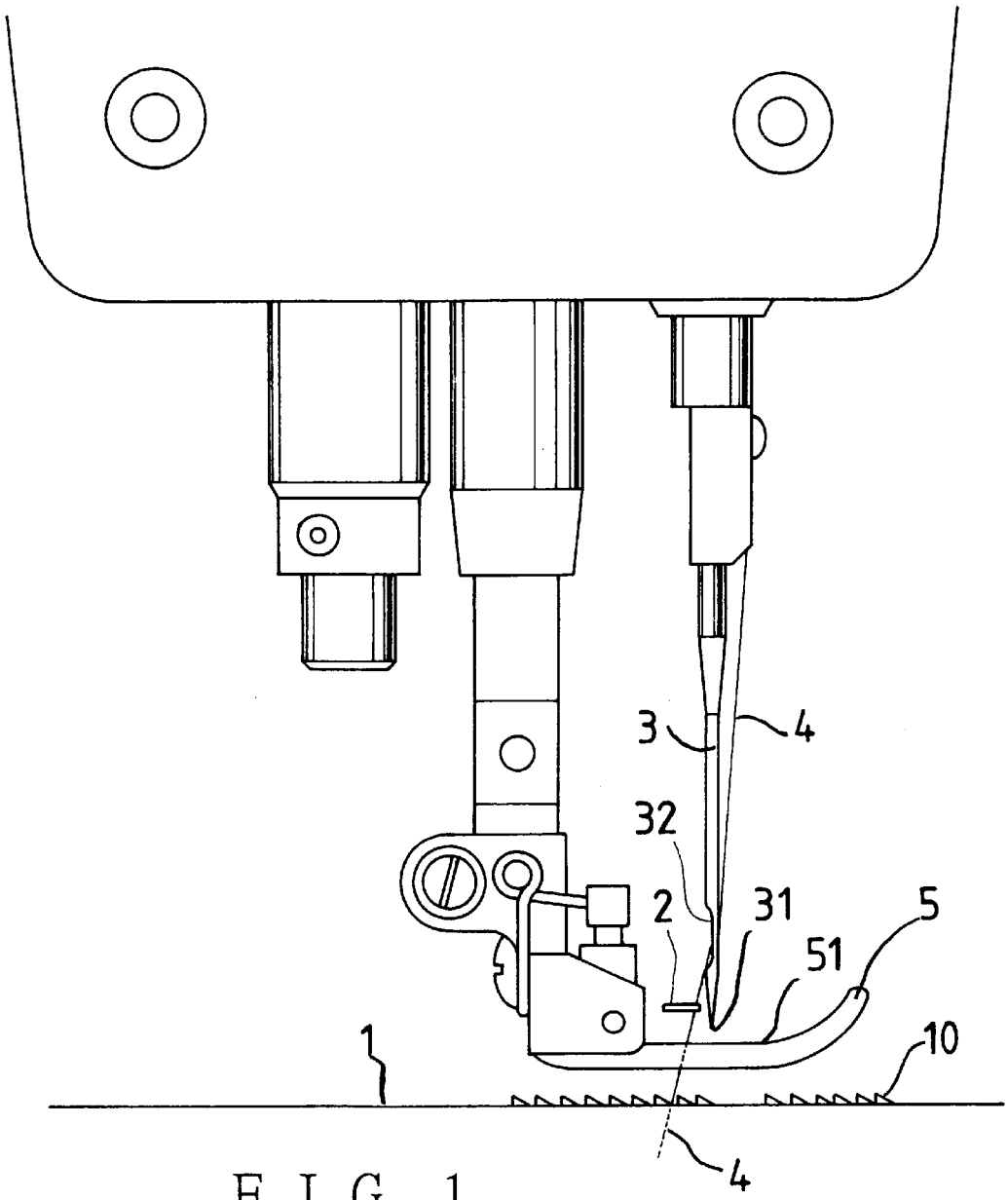
FIG. 1 is a side view of an upper thread-hooking device for industrial sewing machines of the present invention.
Figure 2:
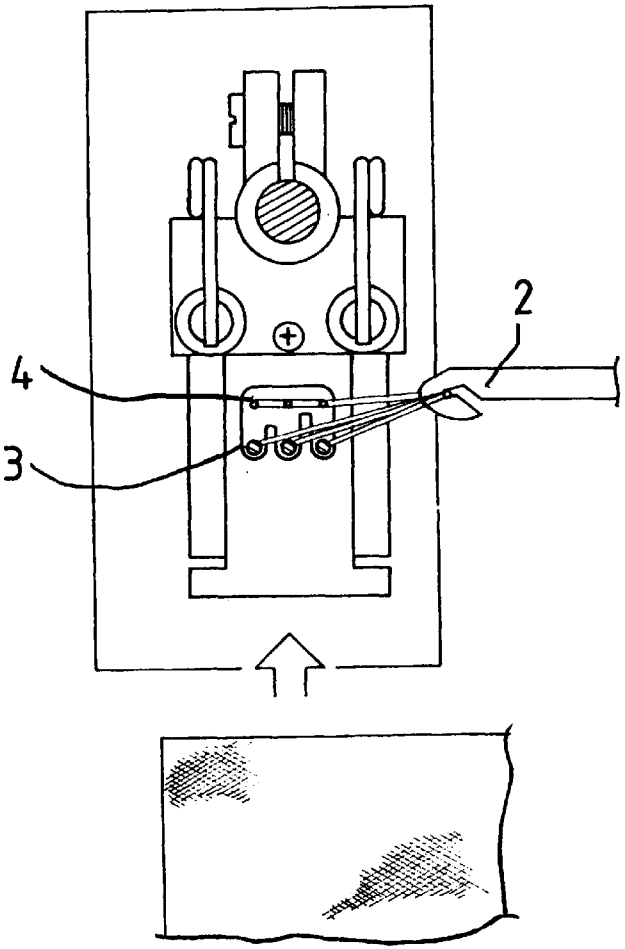
FIG. 2 is an upper view of the upper thread-hooking device for industrial sewing machines of the present invention.

A preferred embodiment of an upper thread-hooking method for industrial sewing machines, as shown in FIGS. 1 and 2, includes a hooking process of a hooking member 2 to be performed at the rear side of the needles 3 and a little above the needle point 31 to hook and pull the thread 4 located between the needle point and the eye 32 of the needle 3.

Figure 3:
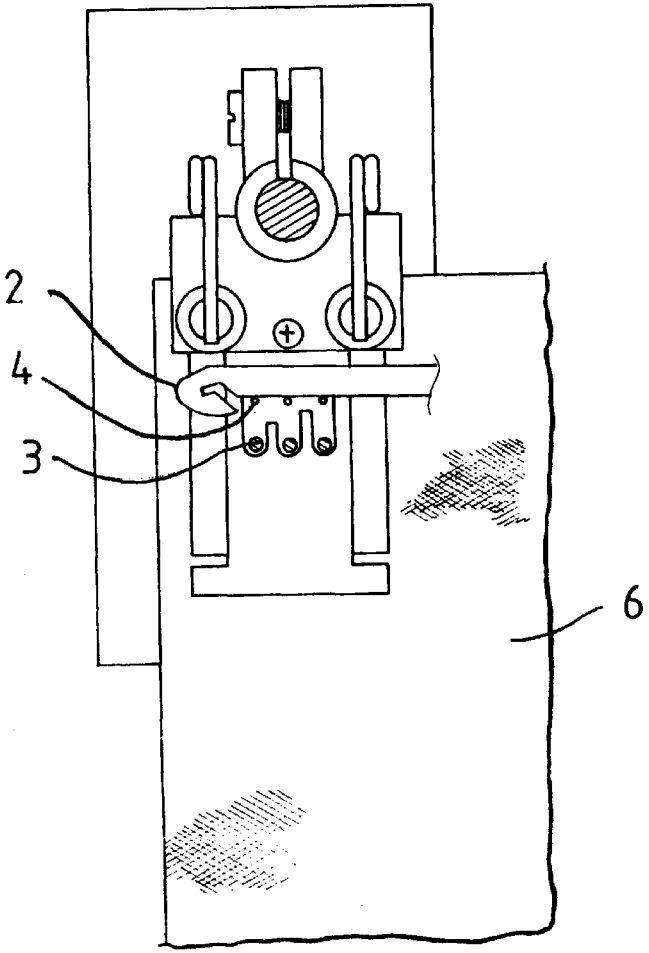
FIG. 3 is an upper view of the upper thread-hooking device being in one motion of the present invention.
Figure 4:
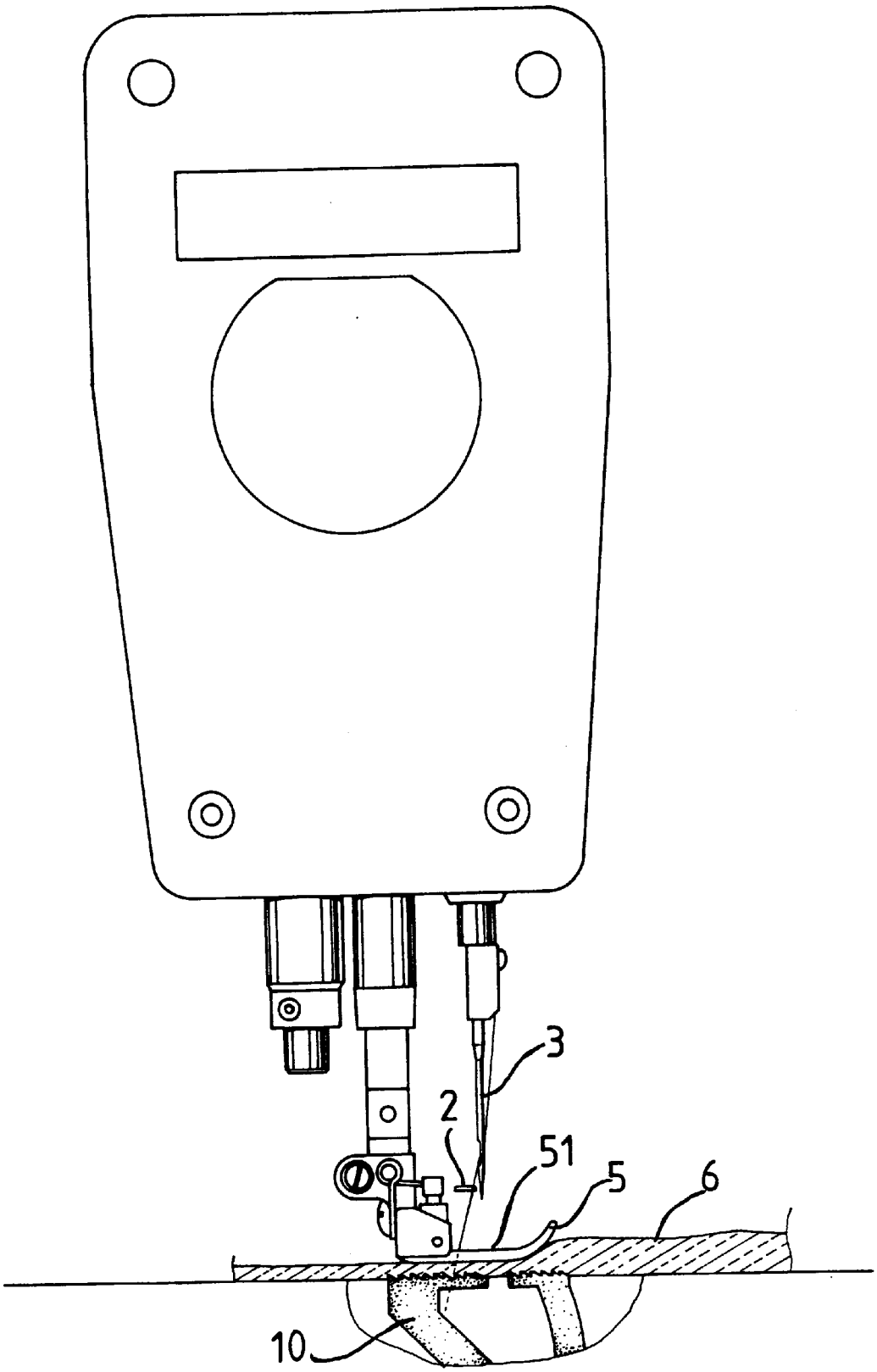
FIG. 4 is a side view of the upper thread-hooking device being in one motion of the present invention.

Next, as shown in FIGS. 3 and 4, when the presser foot 5 presses cloth 6 being sewn on the slide plate 1, the feed dog 10 under the slide plate 1 moves backward the cloth 6 in coordination of up-and-down movement of the needle 3. When the cloth is moved back for one step, the needle 3 rises up to the highest point, and the thread 4 will incline backward at this moment, and then become a sharp cone-shape between the needle eye 32 and the needle point 31 for the hooking member 2 to easily hook this section of the thread 4.

Figure 5:
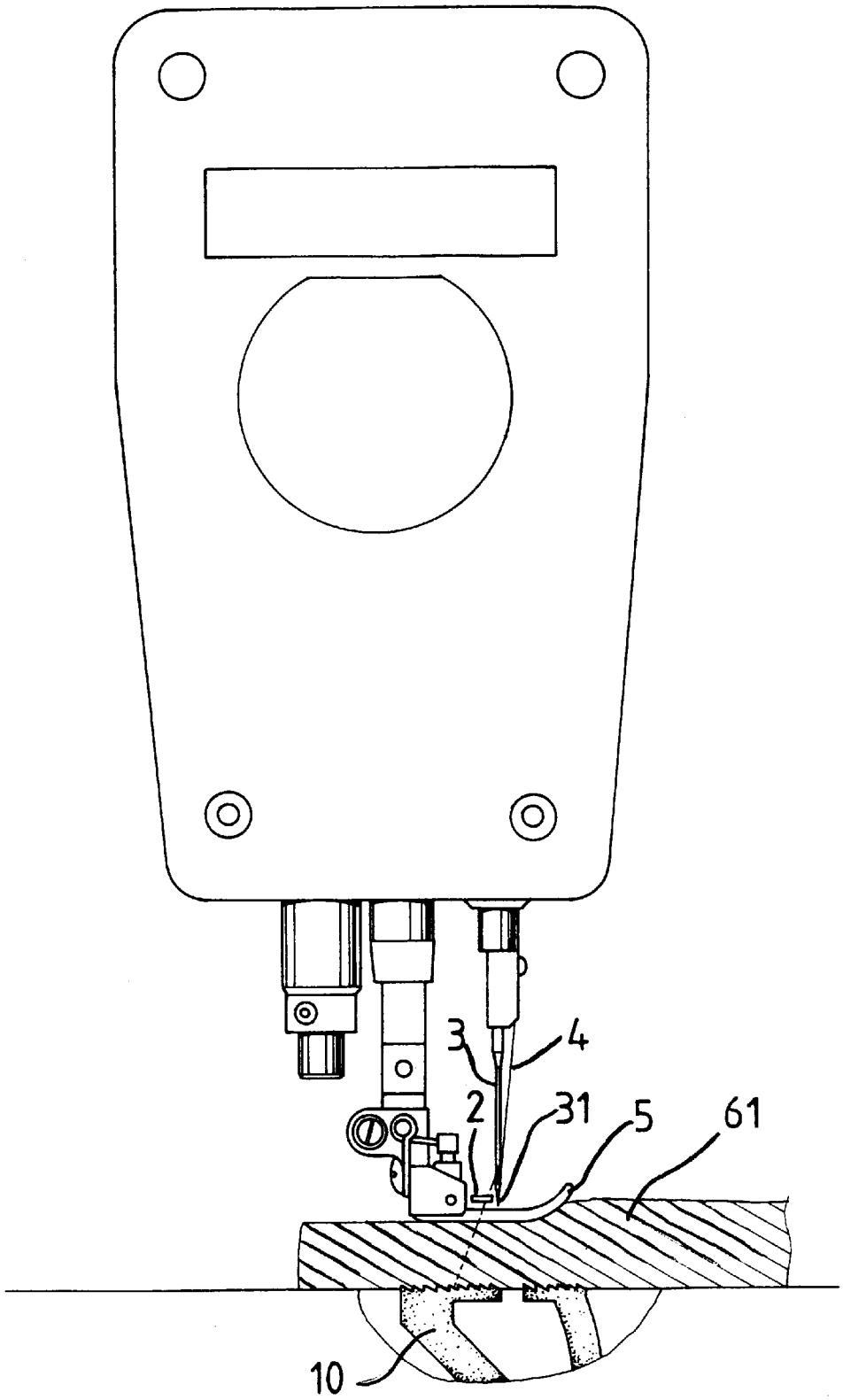
FIG. 5 is a side view of the upper thread-hooking device being in another motion of the present invention.
Figure 6:
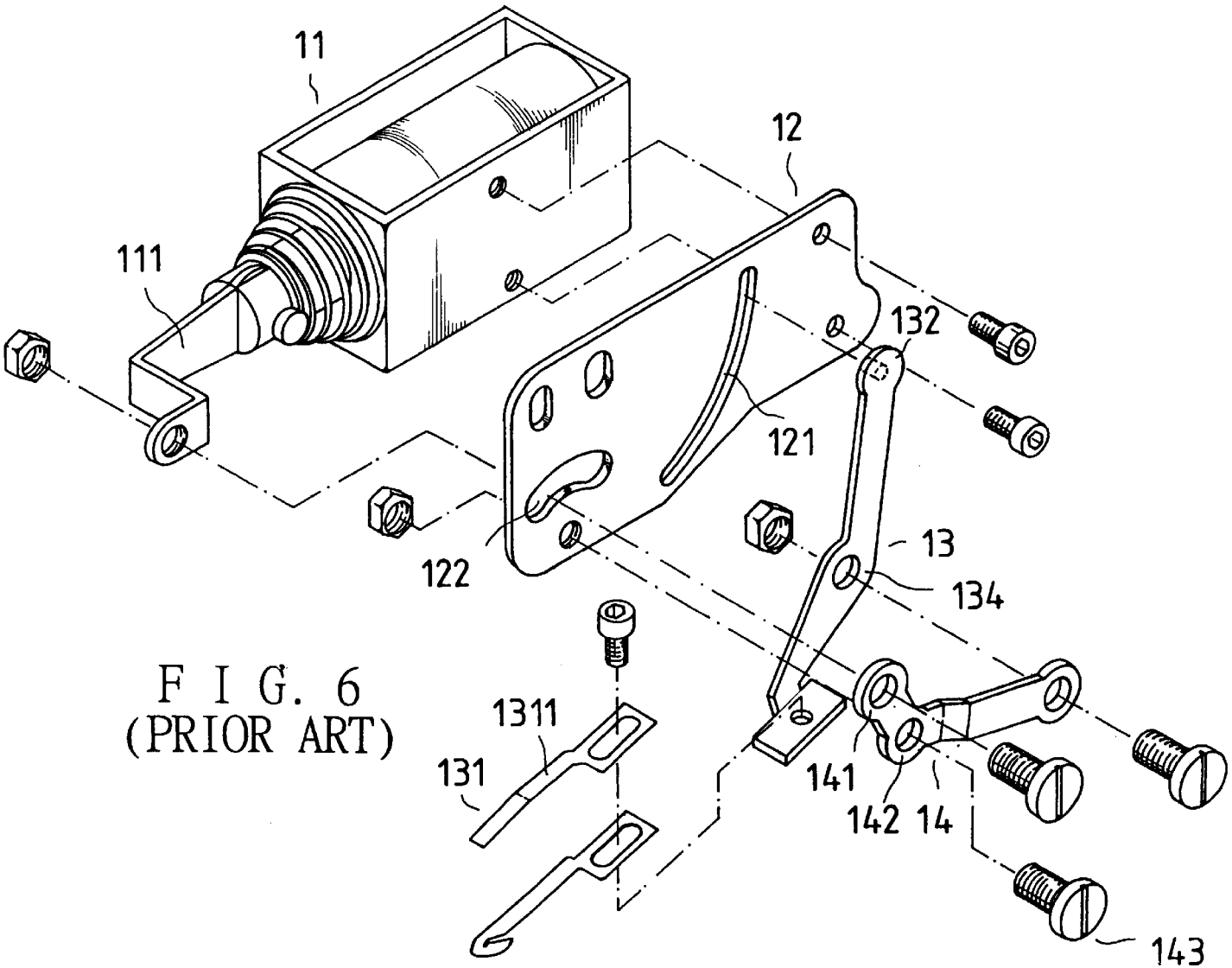
FIG. 6 (PRIOR ART)
FIG. 6 is an exploded perspective view of a conventional upper thread-hooking device in the conventional industrial sewing machines.
Figure 7:
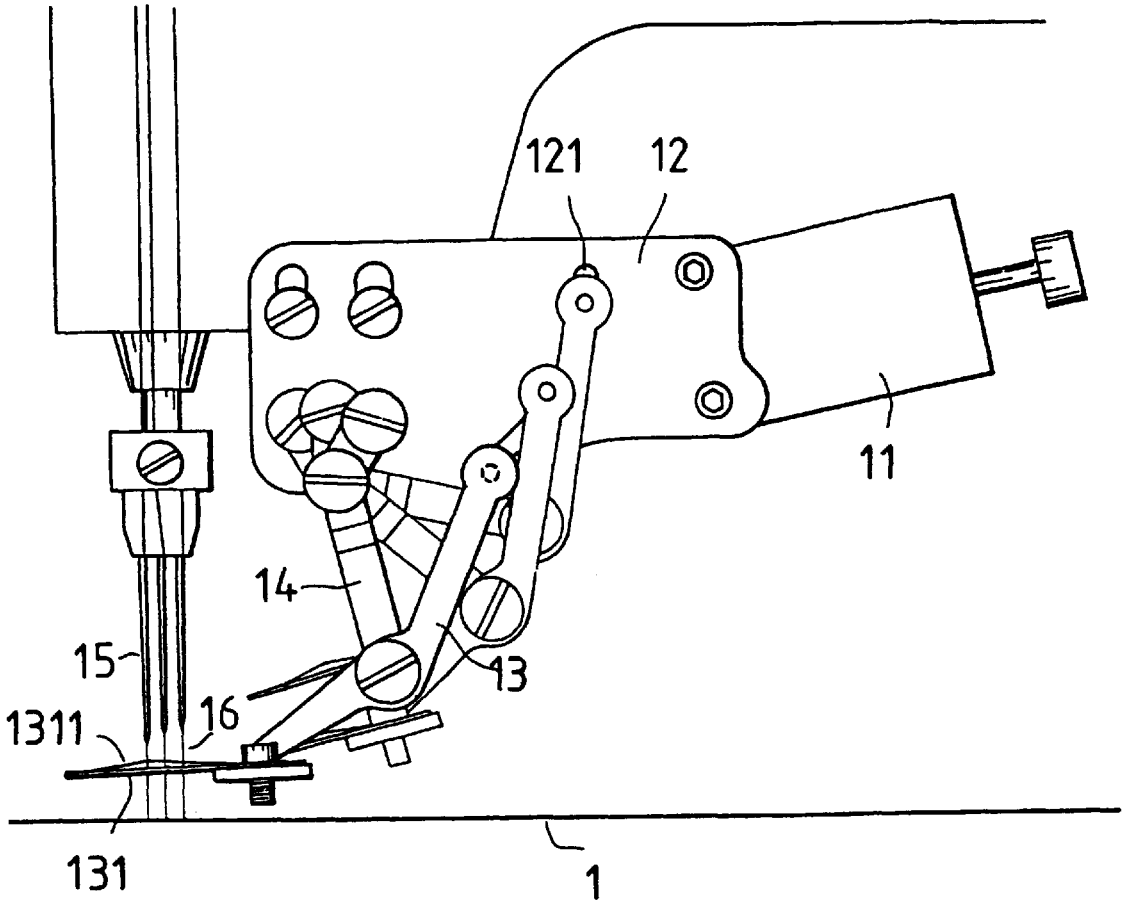
F I G. 7 (PRIOR ART)
FIG. 7 is a side view of the conventional upper thread-hooking device being in one stage of motion.
Figure 8:
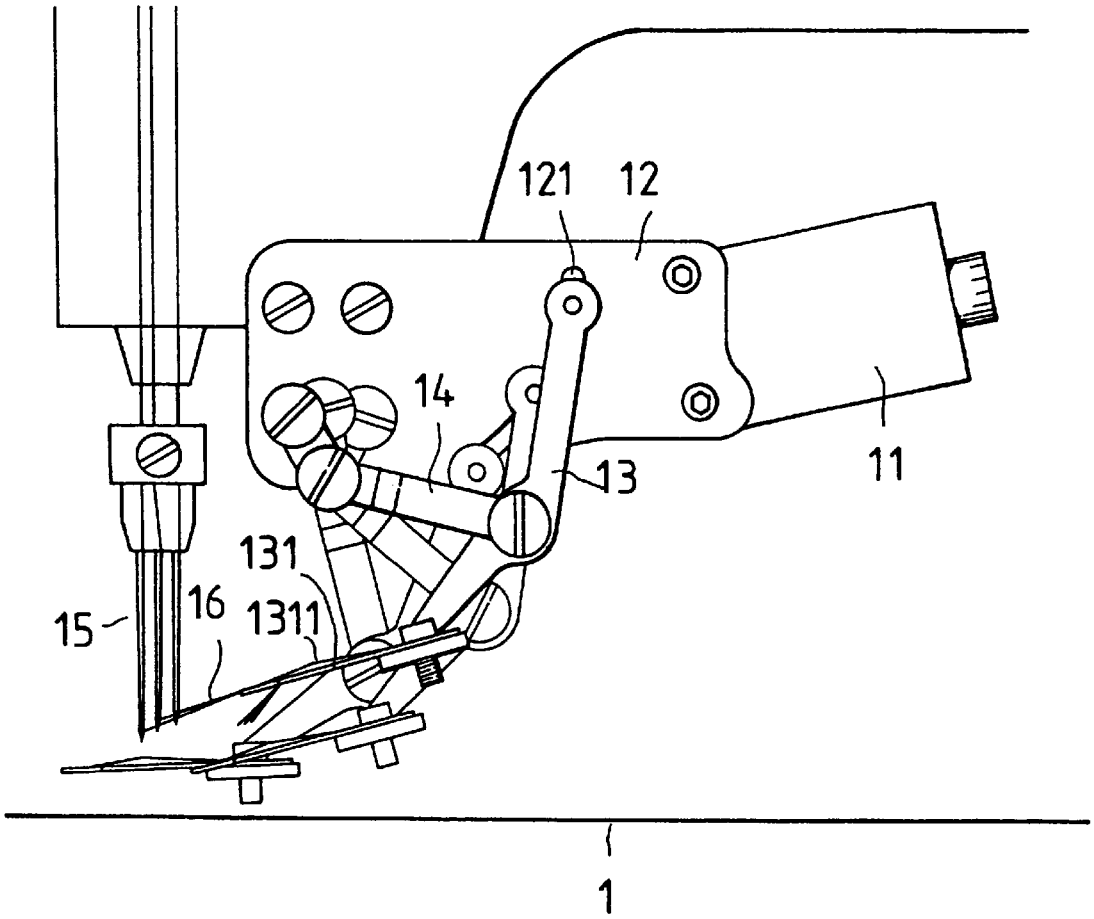
F I G. 8 (PRIOR ART)
FIG. 8 is a side view of the conventional upper thread-hooking device being in another stage of motion.
Figure 10:
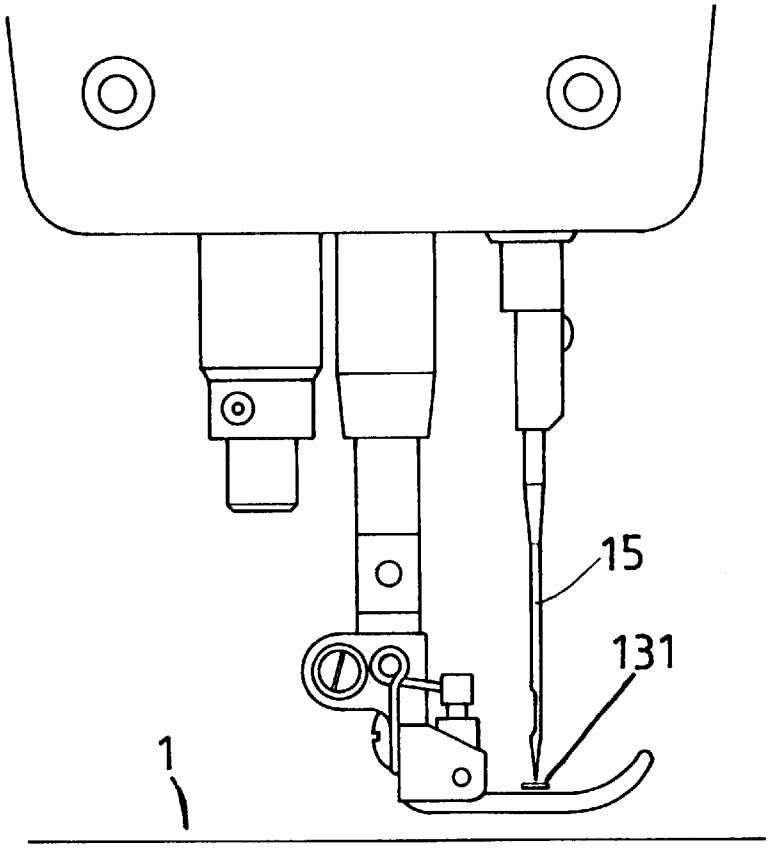
FIG. 10 (PRIOR ART)
FIG. 10 is a side view of the conventional upper thread-hooking device.
Figure 9:
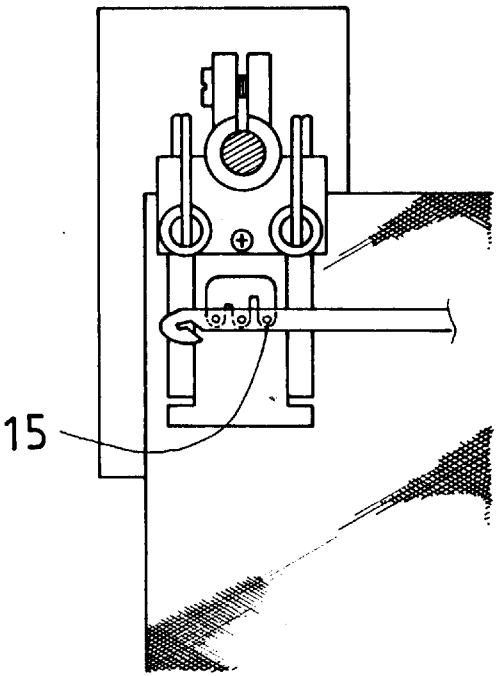
FIG. 9 (PRIOR ART)
FIG. 9 is an upper view of the conventional upper thread-hooking device.

As shown in FIG. 5, when a comparatively thick cloth 61 is being sewn in the upper thread hooking device, even where the needle point 31 has not yet left the upper surface of the presser foot 5, the needle eye 32 is still higher than the upper surface of the presser foot 5, and the thread is inclined, so the hooking member 2 can hook the thread 4 with ease.

The upper thread hooking method of the invention has some advantages, as compared with the conventional method.

1. The hooking member cannot collide with an damage the needle, as it is located behind the needle and far from the moving line of the needle, and hooks the portion of the thread located between the needle eye and the needle point.

2. The hooking member is not located just under the needle point, and does not occupy the gap between the needle point and the upper surface of the presser foot, thereby not affecting the thickness of cloth to be sewn.

3. This method can be applied to any type of industrial sewing machine, as the hooking member of the upper thread-hooking device is located behind the needle.

4. This method can be applied to an industrial sewing machine having a large gap for cloth to be sewn, even for sewing a many-folded side of winter clothing, having a thickness as much as 10 mm.

What is claimed is:

1. An upper thread-hooking device for industrial sewing machines having a presser foot and a needle longitudinally displaced reciprocatingly with respect to the presser foot, the needle having an eye with a thread passing therethrough, said device comprising:

an electronic component having a displaceable end actuated responsive to the needle being maximally displaced above the presser foot;

linkage means coupled to said displaceable end of said electronic component for transferring movement of said displaceable end; and, a hooking member coupled to said linkage means and disposed laterally from a longitudinal axis of the needle and at an elevation between the eye of the needle and a point of the needle when the needle is maximally displaced above the presser foot, said hooking being linearly displaced by said linkage means to hook the thread passing through the eye of the needle.

* * * * *